United States Patent [19]

Williams

[11] 4,437,518

[45] Mar. 20, 1984

[54] APPARATUS AND METHOD FOR IMPROVING THE PRODUCTIVITY OF AN OIL WELL

[75] Inventor: Albert V. Williams, Los Angeles, Calif.

[73] Assignees: Norman Gottlieb; Aileen Williams, both of Long Beach, Calif.

[21] Appl. No.: 218,294

[22] Filed: Dec. 19, 1980

[51] Int. Cl.[3] ..... E21B 43/24; E21B 43/25

[52] U.S. Cl. ..... 166/248; 166/60; 166/177; 166/249

[58] Field of Search ..... 166/249, 248, 302, 177, 166/57, 60, 65 R

[56] References Cited

U.S. PATENT DOCUMENTS

| | | | |
|---|---|---|---|
| 2,670,801 | 3/1954 | Sherborne | 166/249 |
| 2,871,944 | 2/1959 | Pleuger | 166/249 |
| 3,322,196 | 5/1967 | Bodine, Jr. | 166/249 |
| 3,527,300 | 9/1970 | Phillips | 166/249 |
| 3,578,081 | 5/1971 | Bodine | 166/249 |
| 3,583,677 | 6/1971 | Phillips | 166/177 X |
| 3,952,800 | 4/1976 | Bodine | 166/249 |
| 4,257,482 | 3/1981 | Kompanek | 166/249 |

*Primary Examiner*—Stephen J. Novosad

*Attorney, Agent, or Firm*—Fulwider, Patton, Rieber, Lee & Utecht

[57] ABSTRACT

A excitation apparatus is lowered through the casing of an oil well until it is submerged in oil. The apparatus includes a gas discharge tube which emits radiation, either ultraviolet or infra-red, into the surrounding oil. Next, another section of the excitation apparatus provides a mechanical energy input to the oil. The effect is to increase the pressure within the well and to cause the oil to flow more freely, thereby markedly increasing the productivity of the well after the treatment has been completed.

14 Claims, 8 Drawing Figures

APPARATUS AND METHOD FOR IMPROVING THE PRODUCTIVITY OF AN OIL WELL

FIELD OF THE INVENTION

The present invention relates to oil wells, and, more particularly, to a method and apparatus for improving the productivity of oil wells.

BACKGROUND OF THE INVENTION

After an oil well has been in operation for some time, its productivity often diminishes to the point at which the operation of the wells is either marginal or entirely unfeasible from a commercial viewpoint. It is frequently the case, however, that substantial qualities of crude oil remain in the ground in the regions of these unproductive wells but cannot be liberated by conventional techniques.

It is believed that there are a number of causes for the decreased productivity of such wells. A principal cause is the build up of deposits that tend to close perforations in the well casing, thereby preventing the oil from flowing freely to the pump. The composition of these deposits varies from one geographical region to another, and the deposits may be characterized in the art as either "wax" or "chalk".

Another reason for decreased productivity is a decrease in the fluid pressure that causes crude oil to flow, constantly refilling the area in which the pump is located. This pressure is largely attributable to the presence of natural gas within the oil. Often, a major portion of the natural gas present in the vicinity of a well escapes when the well is first opened. It is believed that additional gas remains in the well, perhaps entrained within the oil, and continues to contribute to the fluid pressure. Eventually, as more and more oil is liberated, a larger proportion of the gas escapes or is removed and the pressure diminishes.

An objective of the present invention is to provide an effective and expeditious technique for removing deposits that clog the perforations of oil well casings. A further objective is to provide a technique for stimulating wells to increase the pressure and improve the flow of crude oil into the casings.

SUMMARY OF THE INVENTION

A first aspect of the present invention relates to a method for increasing the productivity of an oil well. An apparatus known as an exciter is lowered through the casing of the well to a level at which it is submerged in oil. The exciter is then caused to emit radiation into the surrounding oil. Next, the exciter is caused to vibrate mechanically, thereby providing a mechanical energy input to the oil.

The radiation can be ultraviolet, including beta radiation, or it can be infra-red. A preferred frequency range for the mechanical vibration is from about 200 to 30,000 hertz. It is most effective to employ a combination of frequencies within this range which produce resonance in the particular well.

Another aspect of the present invention relates to the apparatus for carrying out the method described above. For the input of mechanical energy it includes one or more resonators, while the radiation may be produced by a gas discharge tube. Preferably, the resonators include piezoelectric crystals.

In one embodiment, the resonators are arranged end-to-end in alignment with the gas discharge tube, forming a generally elongated apparatus that can readily pass through the well casing.

Other features and advantages of the present invention will become apparent from the following detailed description, taken in conjunction with the accompanying drawings, which illustrates, by way of example, the principles of the invention.

DETAILED DESCRIPTION OF THE PREFERRED EMBODIMENT

Figure 1:
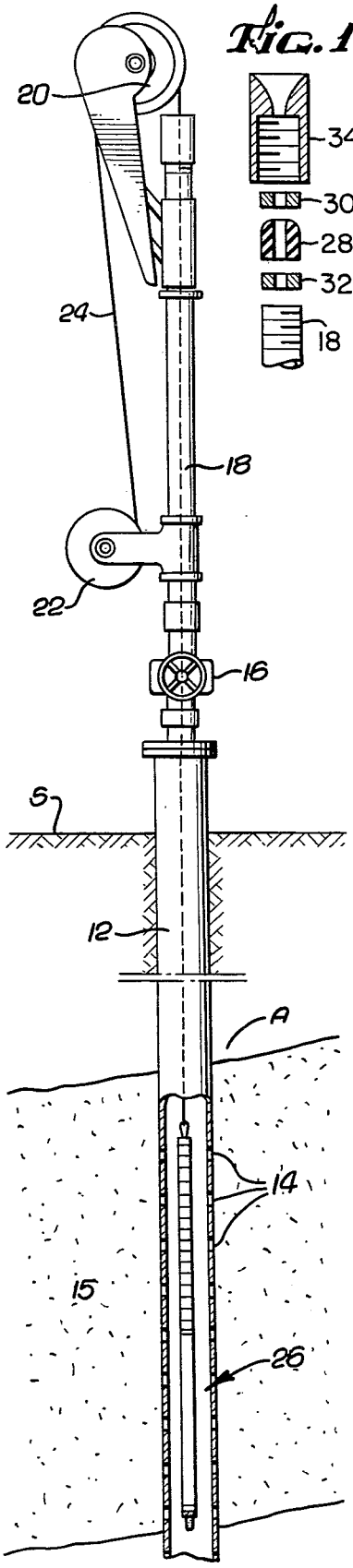
FIG. 1 is a side elevation of an apparatus constructed in accordance with the invention and installed in an oil well, a portion of the well casing being broken away to expose the exciter of the apparatus.

An apparatus 10 constructed in accordance with the invention, shown in FIGS. 1–7 of the accompanying drawings, is used in connection with an oil well. The well includes a conventional vertically oriented cylindrical casing 12 (see FIG. 1) that extends from the surface S to a point below the level A at which oil is present. The casing 12 has perforations 14, in the form of vertically elongated slots, through which oil from the surrounding area 15 enters the casing where a pump (not shown) is disposed. At the top of the well, upward flow through the casing 12 is controlled by a valve 16. The structure and features of the well itself are conventional and, although not shown or described in detail here, are well known to those skilled in the art.

When the apparatus 10 is to be employed, as when the productivity of the well fallen off, the conventional above-ground connections to the valve 16 are removed and a tubular member 18 is attached to the valve so that it forms an upward vertical extension of the casing 12. An idler pulley 20 and a winch 22 are mounted on the extension 18 so that a cable 24 that is looped over the pulley 20 can be lowered through the extension as it is played out by the winch.

Figure 2:
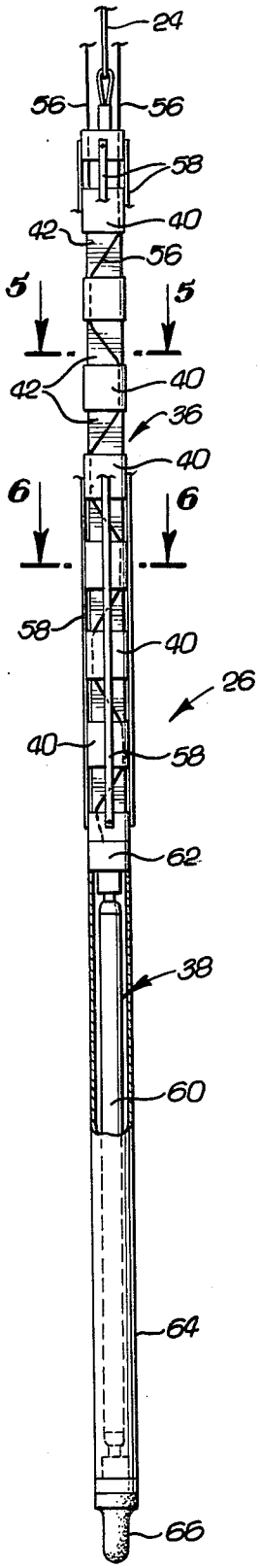
FIG. 2 is a side elevation of the exciter of the apparatus, a fragmentary portion of the radiation emitting portion of the exciter being broken away.

Suspended from the lower end of the cable 24 is an excitation apparatus or exciter 26. The exciter 26 is elongated and generally cylindrical (as best shown in FIG. 2) so that it can pass through the valve 16 into the casing 12 when the valve is in its open position.

Figure 1A:
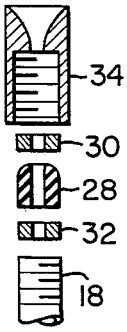
FIG. 1*a* is an enlarged exploded view of a fragmentary portion of the apparatus of FIG. 1.

At the top of the extension 18, the cable 24 passes through central openings in a generally cylindrical rubber plug 28 and two annular thrust members 30 and 32 best shown in FIG. 1*a*. The plug 28 is sandwiched between the two thrust members 30 and 32, with the lower thrust member 32 resting against the top end of the extension 18.

A cap 34 fits over the plug 28 and the thrust members 30 and 32 and threadedly engages the top of the extension 18, the cable 24 emerging through an aperture in the top of the cap. When the cap 34 is screwed down tightly onto the extension 18, it squeezes the plug 28 axially, thus expanding it radially and tending to reduce the diameter of the aperture in the plug, tightening the plug around the cable 24. Accordingly, the plug 28, thrust members 30 and 32, and cap 34 form a means for sealing the well at its top end around the cable 24 to prevent the upward flow of oil through the extension 18.

Figure 3:
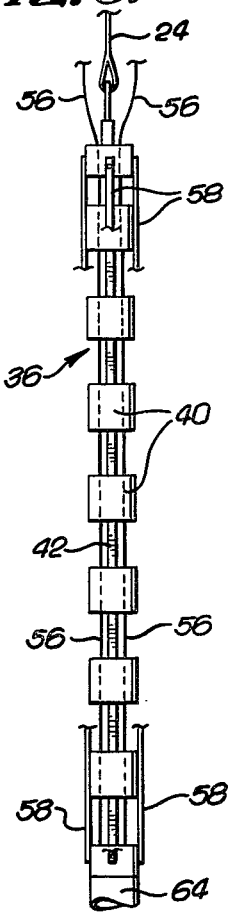
FIG. 3 is a fragmentary side elevation of the vibratory upper section of the exciter taken from a different perspective than in FIG. 2 and shown with part of the supporting structure omitted.
Figure 4:
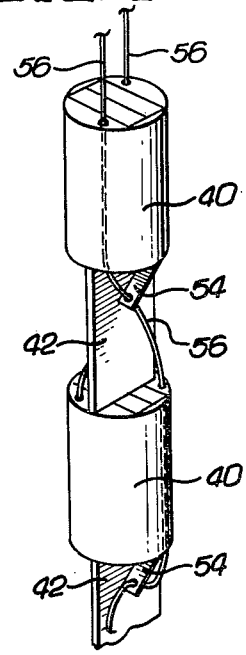
FIG. 4 is a perspective view of a fragmentary portion of the vibratory section of the exciter.

Structurally, the exciter 26 includes a vibratory upper section 36 for providing an input of mechanical energy to the oil and a mechanically static lower section 38 for emitting radiation into the soil. The upper section 36 includes a row of piezoelectric resonators 40 arranged one above the other and separated by flat rectangular spacers 42 of insulative fiber board material, as best shown in FIGS. 3 and 4.

Figure 5:
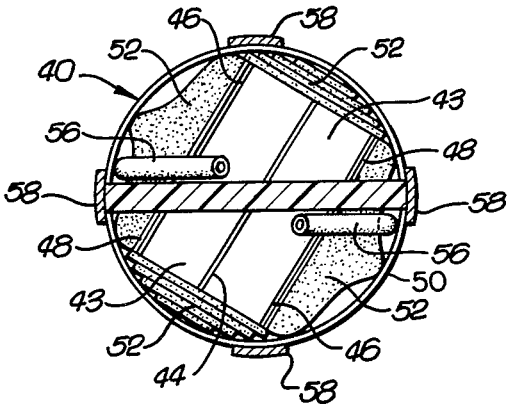
FIG. 5 is a cross-sectional view of the vibratory section taken along the line 5—5 of FIG. 2.
Figure 6:
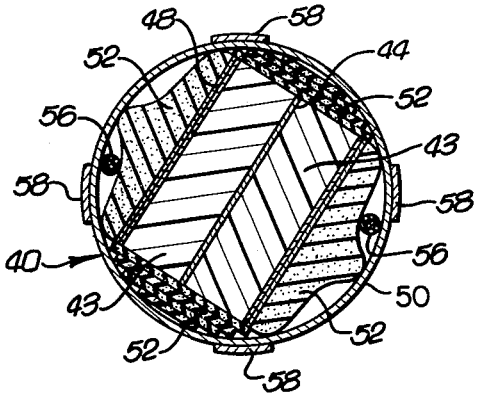
FIG. 6 is a cross-sectional view of the vibratory section taken along the line 6—6 of FIG. 2.
Figure 7:
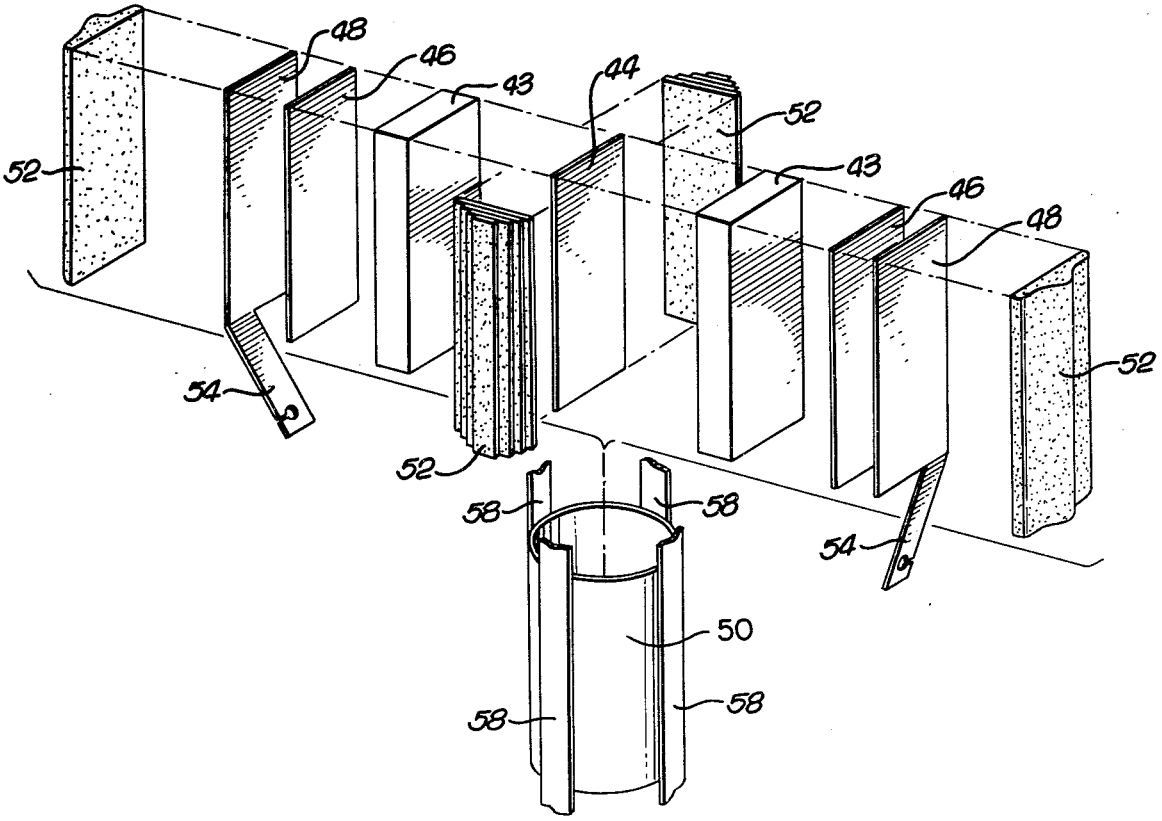
FIG. 7 is an exploded view of a single resonator of the exciter.

The structure of an individual resonator 40, best shown in FIGS. 5, 6 and 7 includes two rectangular blocks 43 of piezoelectric crystaline material separated by a thin conductive metal plate 44. Similar plates 46 overly the outer surfaces of the blocks 42, separating them from more rigid electrode plates 48.

This internal structure of the resonator 40 is wrapped by a cylindrical casing 50 from which it is separated by four resilient rubber pads 52. Each electrode 48 has a downwardly projecting arm 54 connected to one of two power supply wires 56 that extend through out the length of the upper section 36. The resonators are supported by four equally spaced metal strips 58 that each extend longitudinally along the entire upper section 36, being attached to each of the casings 50 to form a frame.

The resonators 40, which are suitable for audio frequency operation, are of a type used for underwater sound ranging equipment such as sonar transmitters. Their construction and the mathematical models that predict their behavior are well known and, therefore, are not described here.

The lower section 38 of the exciter 26 consists of an elongated gas discharge tube 60 and a transformer 62 connected to the wires 56. The tube 60 is contained within a protective transparent cylindrical shield 64 that has a soft protective rubber tip 66 at its lower end. Preferably the tube 60 emits ultraviolet radiation and beta radiation when energized. Alternatively, it may emit infra-red radiation.

When the apparatus 10 is to be used, the exciter 26 is lowered by the cable 24 until it is submerged in the oil within the casing 12 that surrounds the pump (not shown). In anticipation of increased pressure through the extension 18, the cap 34 is screwed down to compress the rubber plug 28, closing the plug and closes it tightly around the cable 24. The apparatus 10 is then ready for use.

First, the gas discharger tube 38 is activated to emit radiation by applying a low frequency (i.e., 60 hertz) alternating current to the electrical wires 56. The resonators 40 do not respond at this frequency. The time period over which radiation should be emitted varies with the size of the gas discharge tube 38 and the size and condition of the well. Typical times, however, might be in the range of about 60 minutes if a wax condition exists in the well and about 30 minutes of a chalk condition exits.

The emission of radiation into the oil sets the stage for the more effective use of the vibratory upper section 36 of the apparatus 10. It is believed that radiation has the effect of separating the entrained natural gas from the oil, thereby increasing the pressure within the well.

The next step is to actuate the vibratory upper section 36. This is accomplished by an input at a high wattage, for example 1500 watt, at two superimposed audio-frequencies, each between about 200 and 30,000 hertz. These frequencies should be selected so that, when combined, they produce a resonance within the well. The optimum frequencies will vary with the characteristics of an individual well. Effective frequencies can be determined by holding one frequency constant while varying the other. The output of an electronic amplifier (not shown) that supplies the signal to the resonantors 40 is monitored to identify a combination of frequencies at which a high energy output is produced. This is the resonant frequency. While a single frequency can be used, it is then necessary to drive the resonators 40 much harder.

It has been found that the mechanical energy input of the resonators 40 to the surrounding oil, following the use of radiation, has two beneficial effects. The first effect is to break up and liquify the scaly or chalky deposits that tend to block the casing perforation 14, thereby permitting an increased rate of oil flow into the casing 12. Another effect is to increase fluid pressure within the well, thereby further increasing the flow rate. Typically, the use of the vibratory upper section 36 might continue for about 120 minutes in the case of a wax condition or about 60 minutes if a chalk condition exists.

When the treatment of the well in the above manner is completed, the exciter 26 is raised by the cable 24, being pulled back up through the valve 16 into the extension 18. If sufficient oil pressure has been generated to cause oil to rise into the extension 18, a tight seal around the cable 24 should be maintained by the plug 28.

Once the exciter 26 has been raised, the valve 16 can be closed and the entire apparatus 10 can then be disconnected from the casing 12. The valve 16 is then reconnected in the normal manner. The well will continue to operate for a considerable period with increase productivity before another treatment in accordance with the invention is required.

It will be appreciated from the above description that the present invention provides a simple and highly effective, although inexpensive, treatment for oil wells whereby the production of such wells can be marketedly increased. Oil which was not previously recoverable within economic limits thus becomes available for use.

It will be understood from the following that while a particular form of the invention has been illustrated and described, various modifications can be made without departing from the spirit and scope of the invention. Accordingly, it is not intended that the invention be limited except as by the appended claims.

I claim:

1. A method of increasing the productivity of an oil well comprising:

lowering an excitation apparatus through the casing of said well to a level at which said apparatus is submerged in oil;

causing said apparatus to emit ultraviolet radiation into the surrounding oil; and causing said apparatus to vibrate mechanically, thereby providing a mechanical energy input to said oil.

2. The method of claim 1 wherein said radiation includes beta radiation.

3. The method of claim 1 wherein said radiation is infra-red.

4. The method of claim 1 wherein said mechanical vibration is at a frequency between about 200 and 30,000 hertz.

5. The method of claim 1 wherein said mechanical vibration is at two or more frequencies each between about 200 and 30,000 hertz, said frequencies being selected to produce resonance within said oil.

6. A method of increasing the productivity of an oil well comprising:

supporting an excitation apparatus from a cable and lowering said apparatus through the casing of said well until said apparatus is submerged in oil;

sealing said well at the top end thereof around said cable;

causing said apparatus to emit ultraviolet radiation into the surrounding oil;

causing said apparatus to vibrate, thereby providing a mechanical energy input to said oil; and raising said apparatus by said cable while continuing to seal said well around said cable.

7. The method of claim 6 wherein said mechanical vibration is at a frequency between about 200 and 30,000 hertz.

8. The method of claim 6 wherein said mechanical vibration is at two or more frequencies each between about 200 and 30,000 hertz, said frequencies being selected to produce resonance within said oil.

9. An apparatus for treating an oil well to increase its productivity comprising:

resonator means for producing mechanical vibrations in response to one or more input signals of selected frequencies and thereby providing a mechanical energy input to surrounding oil; and radiation means including a gas discharge tub for emitting radiation into the surrounding oil.

10. The apparatus of claim 9 wherein said resonator means comprises a plurality of individual resonators arranged in a row.

11. The apparatus of claim 10 wherein said resonators include piezoelectric crystals.

12. The apparatus of claim 9 wherein said radiation means is a means for emitting ultraviolet and infra-red radiation.

13. An apparatus for treating an oilwell to increase its productivity comprising:

a tubular extension to be aligned with the casing of said oil well;

an elongated frame to be lowered through said extension and down the casing of the well;

a plurality of piezoelectric resonator means arranged in a row along said frame for producing mechanical vibrations in response to one or more audio frequency input signals selected to produce resonance in surrounding oil, thereby providing an input of mechanical energy to said oil;

radiation means including a gas discharge tube attached to said frame for emitting ultraviolet or infra-red radiation into said oil;

a cable secured to said frame at one end thereof;

winch means for lowering and raising said frame with said resonator means and said radiation means within said extension and said casing; and seal means mounted on said extension for sealing said well around said cable.

14. A method of increasing the productivity of an oil well comprising:

lowering an excitation apparatus through the casing of said well to a level at which said apparatus is submerged in oil;

causing said apparatus to emit beta radiation into the surrounding oil; and causing said apparatus to vibrate mechanically, thereby providing a mechanical energy input to said oil.

* * * * *